United States Patent [19]

Ruf et al.

[11] 3,953,020

[45] Apr. 27, 1976

[54] BAG ALIGNER MACHINE

[75] Inventors: Walter Ruf, Spring Valley; Robert George Kelley, Central Valley, both of N.Y.

[73] Assignee: St. Regis Paper Company, New York, N.Y.

[22] Filed: Jan. 27, 1975

[21] Appl. No.: 544,020

[52] U.S. Cl. ..... 271/14; 53/188; 214/8.5 D; 271/91; 271/227; 271/241; 271/267

[51] Int. Cl.[2] ..... B65H 3/08; B65H 5/10; B65H 9/10

[58] Field of Search ..... 271/11, 14, 15, 93, 271/91, 225, 194, 267, 268, 241, 226, 227, 228, 10, 248–250, 252, 245; 53/188; 214/8.5 D, 1 B H

[56] References Cited

UNITED STATES PATENTS

| | | | |
|---|---|---|---|
| 3,509,689 | 5/1970 | Perrin | 53/188 |
| 3,656,744 | 4/1972 | Gray et al. | 271/194 X |
| 3,691,715 | 9/1972 | Kelly et al. | 53/188 X |
| 3,829,702 | 8/1974 | Eriksson | 271/227 X |
| 3,866,764 | 2/1975 | Leiser | 271/91 X |

*Primary Examiner*—Evon C. Blunk
*Assistant Examiner*—Bruce H. Stoner, Jr.
*Attorney, Agent, or Firm*—Woodling, Krost, Granger & Rust

[57] ABSTRACT

The openable end of a collapsed bag is aligned in an alignment station on the base of the bag aligner machine. The bag is removed from a bag pickup station by a pick-off arm and moved to a preliminary position. At this point the bag is transferred to a bag holder which moves upwardly relative to the base to move the openable end of the bag into a bag-edge locator. This locator includes first and second alignment members which are interconnected in generally a V configuration and the bag openable edge is moved by a first motor into the open V end between the first and second alignment members to abut the closed V end under the urging of the first motor and additional urging of resilient means. This positively locates the edge of the bag so that it may be subsequently gripped, opened and then filled at a subsequent filling station.

18 Claims, 3 Drawing Figures

BAG ALIGNER MACHINE

BACKGROUND OF THE INVENTION

Many bag-filling machines have been devised and for many different styles of bags. A prior art machine has been constructed for filling pinch bottom paper bags, either lined or unlined bags, but the speed has been quite slow. Also, with the larger sizes of bags, especially in the pinch-bottom style of paper bag, the height of the bag is not completely uniform from one bag to the next. The prior art system has been to align the top edge of the bag relative to the filling mechanism by gripping the top edge of the bag with the bag oriented by resting on the bottom edge. It has now been found that the height of the bag might vary as much as 0.25 inches (0.635 cm.), and this made the gripping of the openable top edge of the bag vary by as much as this amount of 0.25 inches.

Recently, there has been an increased emphasis on tightly sealing these pinch-bottom bags, especially when finely powdered material such as portland cement is being packaged. Another critical use is in the packaging of food stuffs such as flour which is to be shipped overseas. The pinch-bottom type of bag may have a band of adhesive, for example, 1.5 inches (3.82 cms.) applied along one inner face near the openable edge. After filling this adhesive covered face is turned down a certain amount, e.g., 1.0 inches (2.54 cms.) and sealed. This may be accomplished by heating if it is a heat-sealable adhesive. If the bag varies by as much as 0.25 inches in height, then this means that folding over a flap on the top edge this flap might be 1.0 inches or it might be 1.25 inches (3.18 cms.). This much of a variation in the width of the flap can mean a failure to completely seal the contents within the bag. If the folded-over flap is too narrow or if it is too wide, then leakage can occur at the two ends of the flap. Not only can leakage occur, but vermin seem to be able to enter even the tiniest crevice. Accordingly, for bags to contain foodstuffs such as flour, the proper aligning of the openable top edge of the bag is extremely important.

Accordingly, this problem is solved according to the present invention by providing a bag-aligner machine which aligns an edge of a bag by actually locating the openable edge of the bag rather than attempting to determine where that edge of the bag might be from the opposite end of the bag.

An object of the invention is to provide a bag-aligner machine which obviates the above-mentioned disadvantages.

Another object of the invention is to provide a bag-aligner machine wherein a bag holder moves an edge of a bag into the open end of a V configuration of first and second alignment members until the edge of the bag abuts closed V end.

Another object of the invention is to provide a bag edge locator for a pinch-bottom bag so that the openable edge of the bag may be properly gripped, opened and filled and then folded and sealed so that the sealing is proper and prevents leakage of the contents from the bag.

Another object of the invention is to provide a bag-aligner machine wherein a first motor and resilient means moves a bag holder holding the bag so that an edge of the bag is moved into the open V-end between first and second alignment members to abut the closed V-end under the urging of the resilient means.

SUMMARY OF THE INVENTION

The invention may be incorporated in a bag aligner machine for use with a bag pickup station comprising in combination, a base; an alignment station on said base and including a bag edge locator having a first and a second alignment member interconnected in generally a V configuration, a bag holder movable relative to said base toward and away from the open V end of said alignment members, means including resilient means and a first motor acting between said bag holder and said base to actuate said bag holder between a preliminary position and a bag edge locator position, and control means connected to control said motor and bag holder to establish the bag holder for support of a bag thereby, to control said first motor to move said bag holder from said preliminary position to said bag edge locator position whereat an edge of the bag is moved into the open V end between the first and second alignment members to abut the closed V end under the urging of said resilient means.

DESCRIPTION OF THE PREFERRED EMBODIMENT

Figure 1:
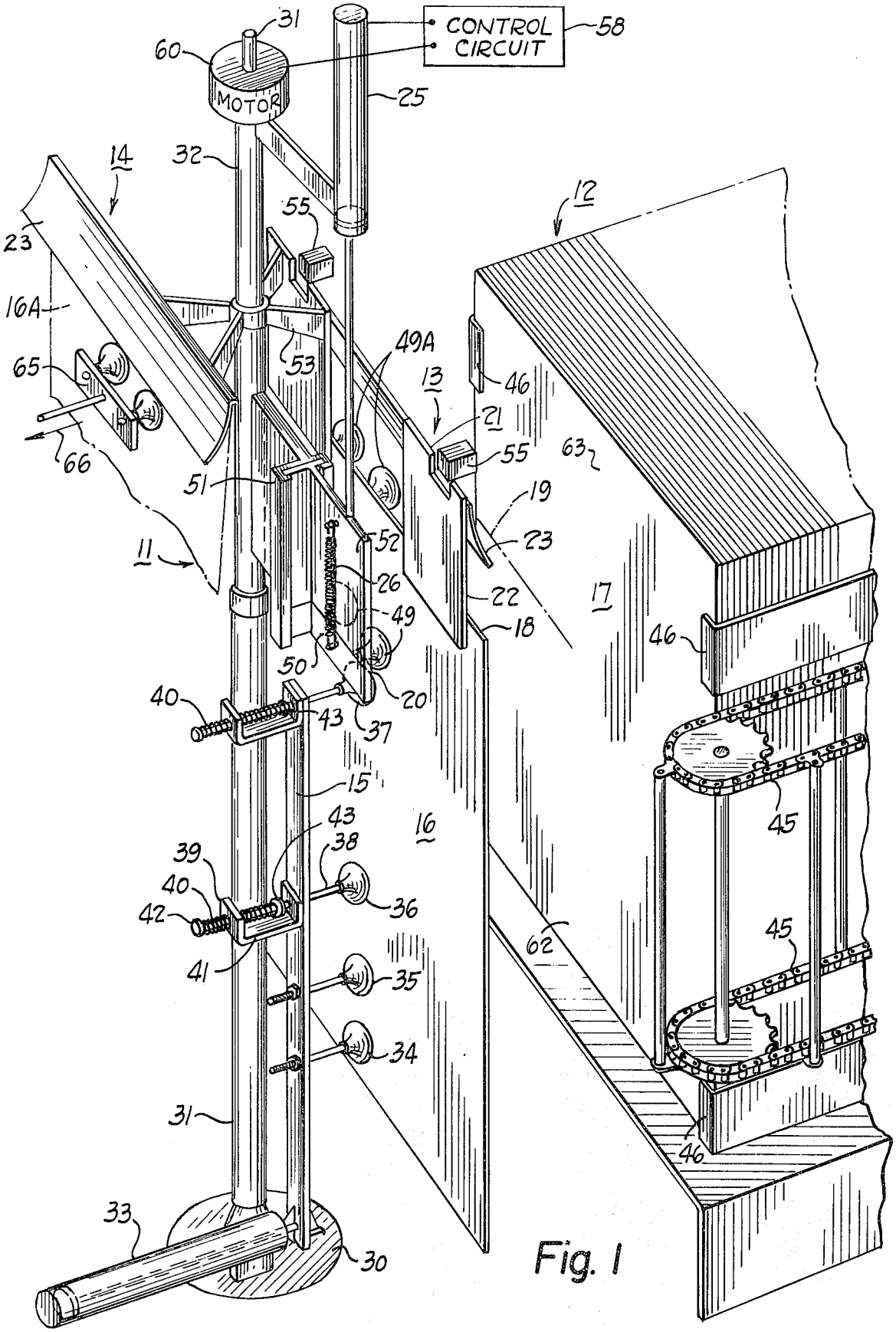
FIG. 1 is a perspective view of a bag aligner machine in accordance with the invention.
Figures 2, 3:
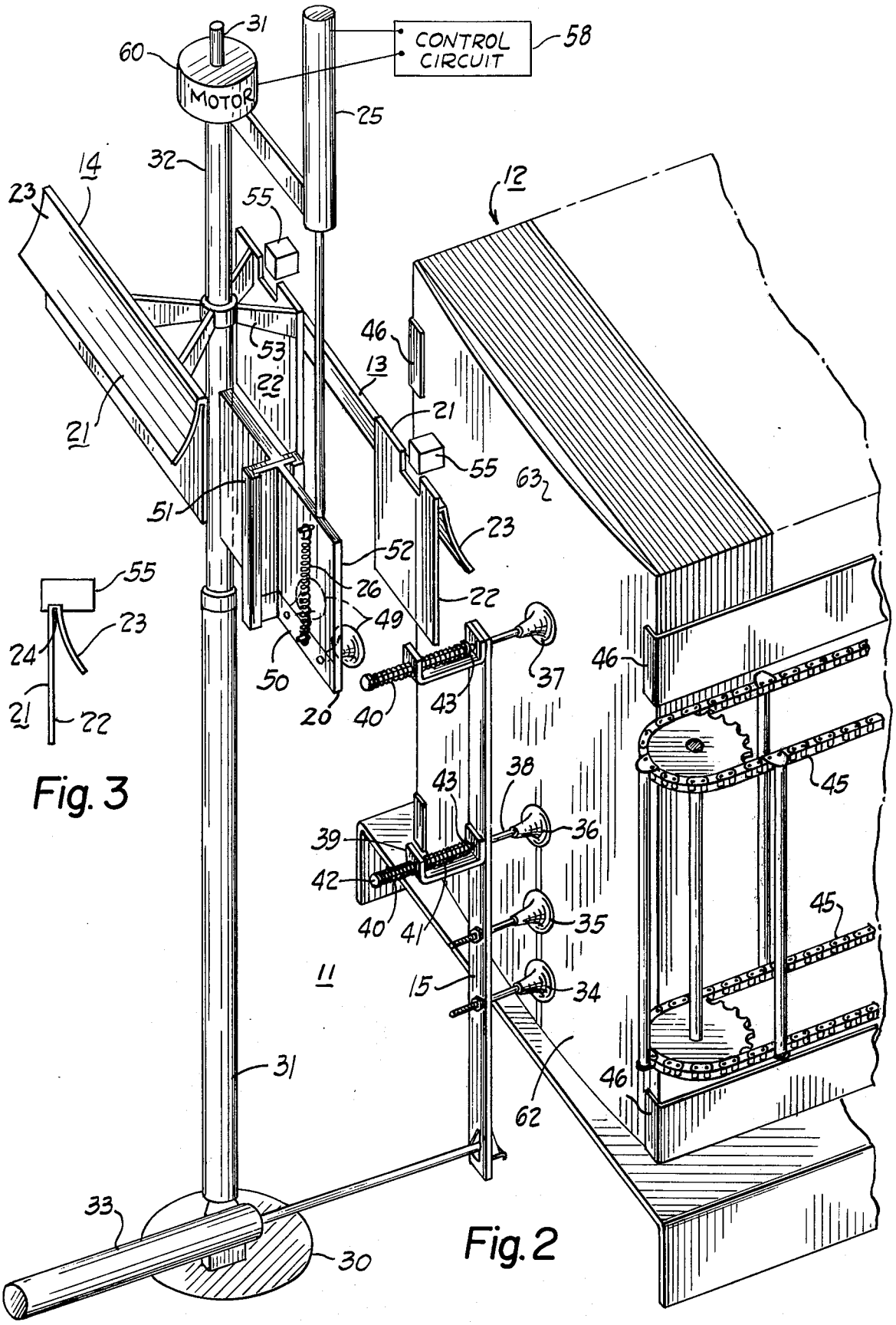
FIG. 2 is a similar perspective view of the machine with the pick-off arm advanced.
FIG. 3 is an end view of the bag edge locator.

FIGS. 1 and 2 show a bag-aligner machine 11 which is used with a bag magazine 12 and includes alignment stations 13 and 14. The alignment stations 13 and 14 preferably are identical and are used alternately in connection with a pick-off arm 15 to move a bag 16 from a bag pickup station 17 on one end of the magazine 12 to a preliminary position shown in full lines in FIG. 1. From this preliminary position a bag holder 20 moves an openable edge 18 of the bag to a locator axis 19 to definitely locate or align this edge of the bag. The alignment station 13, as described in detail and as representative of the two alignment stations 13 and 14, includes a bag-edge locator 21 which establishes the locator axis 19. This bag-edge locator 21 includes generally first alignment members 22 and second alignment members 23 which are shown in this preferred embodiment as being one integral piece. The first and second alignment members are interconnected by a narrow top wall 24 in generally a V configuration with the open end of the V directed downwardly and with the closed end of the V establishing the locator axis 19. In this embodiment axis 19 is horizontal. A first motor 25 and resilient means 26 act to move the bag holder 20 from the preliminary position shown in FIG. 1 to a bag edge locator position whereat the openable edge 18 of the bag 16 abuts the closed V end under urging of the resilient means 26.

In more detail the bag aligner machine includes a base 30 with a column 31 fixed upright thereon. A frame 32 is journalled for rotation on the base 30 about the vertical axis established by the column 31. The pick-off arm 15 is moved by a second motor 33 between a preliminary or retracted position shown in FIG. 1 and an advanced position shown in FIG. 2 adjacent the bag pickup station 17. The pick-off arm 15 carries first, second, third, and fourth suction cups 34–37, respectively. The first and second cups 34 and 35 are adjustably fixed on the pick-off arm 15, and the third and fourth suction cups 36 and 37 are resiliently held on the pick-off arm 15. This resilient mounting may be effected by a central rod 38 passing through apertures in the arm 15 and a bracket 39 with a spring 40 acting between the bracket 39 and a collar 42 on the rod 38 and another spring 41 encircling the rod 38 and acting between the other side of the bracket 39 and another collar 43. By adjusting the positions of the collars 42 and 43 along the rod 38, the force of the springs 40 and 41 may be varied as well as varying the static position of the suction cup 36. A similar arrangement is provided for suction cup 37. All of the suction cups 34–37 are adjusted to lie in a common vertical plane so that when the pick-off arm 15 is advanced to the bag pickup station, the cups will engage the foremost bag in the magazine 12, which is the bag pickup station. The magazine 12 may be of any desired configuration and in the simplified construction shown it has lugged chains 45 to urge the vertically disposed bags in the magazine 12 toward abutments 46 at the bag pickup station 17.

The bag holder 20 has means to hold the bag 16, and in this preferred embodiment are shown as suction cups 49 positioned side by side in a horizontal line and mounted on a movable first slide 50 which slides vertically relative to a bracket 51 fixed on the rotatable frame 32. A second slide 52 also is mounted for vertical sliding movements on the bracket 51 and this slide 52 is connected to be moved by the first motor 25, which is mounted on the rotatable frame 32. The resilient means 26 is shown in this preferred embodiment as a tension spring interengaging the slides 50 and 52 to urge the first slide upwardly toward the locator axis 19. The suction cups 49 are mounted close enough together to hold the bag and move upwardly between the first alignment members 22 to the phantom positions 49A shown in FIG. 1. The bag edge locator 21 of the alignment station 13 is mounted by a bracket 53 on the rotatable frame 32.

Two sensors 55 are mounted in apertures on the locator 21. These may be electrical switches but preferably are pneumatic sensors to sense the presence of the top edge 18 of the bag 16 in the closed end of the V configuration of the bag edge locator 21. These sensors 52 are connected to a control circuit 58 which is also connected to control the suction applied to the suction cups 34–37 and 49, by lines which have been omitted from the drawing in order to avoid complicating the drawing but in a well known manner. A third motor 60 is an indexable motor, preferably air operated, to index the rotatable frame 32 in increments, preferably 180° increments so that the alignment stations 13 and 14 are alternately presented in the position shown in FIG. 1 of the station 13. The control circuit controls operation of the first, second and third motors 25, 33, and 60. In the preferred embodiment all of the controls are pneumatic or air operated in order to avoid electrical contacts which might arc. This avoids any arcing which could be a hazard in a dusty atmosphere, which is quite prevalent in bag filling.

The alignment station 14 has been shown only partially in order to avoid complicating the drawing, but it will be understood that the parts therein are a duplicate of those in the alignment station 13 which generally are those parts mounted on the rotatable frame 13.

OPERATION

The magazine 12 provides a constant supply of vertically disposed bags to the back pickup station 17. The pick-off arm 15 reciprocates by means of the second motor 33 between the retracted preliminary position shown in FIG. 1 and an advanced position generally as shown in FIG. 2 whereat the suction cups 34–37 engage the exposed face of the bag in the pickup station. When the suction cups are in engagement with such bag, then suction is applied to these cups by the control circuit 58. This holds the bag and next control circuit 58 causes the motor 33 to start retraction.

The suction cups 34 and 35 are adjustably fixed on the pick-off arm 15 whereas cups 36 and 37 are resiliently mounted on this arm. This means that the first part of the retracting movement of the pick-off arm 15 causes the bag to be longitudinally creased in a vertical line outwardly away from the next adjacent bag in the magazine 12. This fixed mounting of the suction cups 34 and 35 and the resilient mounting of the cups 36 and 37 means also that the bottom 62 of the bag 16 will be pulled away from the next adjacent bag in the magazine 12 before the top portion 63 of the bag is pulled away. This does two things, it tends to pull the selected bag away from the abutments 46 because of the creasing action, and it tends to break any vacuum which may exist between adjacent bags in the magazine 12. Hence, the bottom 62 of the bag pulls away from the magazine first aided by compression of the springs 40 and then shortly thereafter the suction cups 36 and 37 pull loose the top portion 63 of the bag from the abutments 46. This slight longitudinal creasing action is as shown in FIG. 2. The control circuit 58 controls the complete retraction of the pick-off arm 15 by the second motor 33 until it reaches the preliminary position shown in FIG. 1. In this position the bag 16 positioned so that the top portion 63 of the bag 16 is vertically below the locator axis 19. In this preferred embodiment the top portion 63 of the bag will just touch the first alignment members 22 and will also touch the suction cups 49 on the bag holder 20. Next, the control circuit 58 applies suction to the suction cups 49 so that the bag 16 is held by these cups in the bag holder 20. Next, the control circuit 58 releases the suction on the suction cups 34–37 thus completing the transfer of the holding of the bag from the pick-off arm 15 to the bag holder 20. Next, the control circuit 58 controls movement of the first motor 25 so that the second slide 52 is moved vertically a given distance. In one bag aligner machine constructed in accordance with this invention such given distance was about 8 inches (20.3 cms.). This given distance is adjusted to be slightly in excess of the distance needed to move the shortest bag so that the top openable edge 18 of this bag will be at the locator axis 19. It has been found that many bags, as manufactured, are not of consistent height, and, where the height of such bag might be 30 inches (76.2 cms.), for example, then this height may vary as much as 0.25 inches (0.635 cms.). It has also been found that with many types of bags such as those with adhesive applied along the inner face of the bag with the bag to be later folded over and sealed by activating the adhesive, then it is critical that such top edge of the bag be located with precision in order to achieve a complete and tight seal after the bag has been filled. The present invention does achieve this precise locating of the top edge of the bag rather than trying to determine the location of the top edge by the bottom edge of such bag.

The bag holder 20 utilizes at least one suction cup 49 which is rotationally resilient between the lip of the cup and the mounting thereof. In the preferred embodiment shown, a pair of resilient suction cups 49 are used and mounted close together to still achieve this rotational resilience. This permits the bag to rotate slightly to square up to be aligned at the axis 19 as it is driven into the bag edge locator 21. This is in addition to the vertical positioning and the combination establishes correct aligning of a bag which may be tilted when in the magazine 12.

The fact that the given distance of movement of the second plate 52 is greater than the largest spacing between the locator axis and the top edge 18 of any of the bags, means that all of the bags of the magazine 12 will be sequentially jammed into the closed end of the V configuration of the alignment members 22 and 23. The open end of the V guides the top edge 18 into this bag edge locator 21 and the movement of the first motor 25 forces the top edge 18 up to the locator axis, aided by the resilient means 26. Preferably the locator axis 19 is at a narrow top wall 24, rather than a sharp V without a top wall, as shown best in FIG. 3. This narrow top wall 24 is preferred in use with many bags, especially those of many layers of paper, those with wavy edges, and those with wavy top edges which are stiff from the adhesive thereon.

When the top edge 18 is jammed into the closed V end of the bag edge locator 21, then the suction cups 49 and first slide 50 will cease movement and the tension spring 26 will extend slightly. Thus, the force moving the edge 18 to the locator axis 19 is a combination of the force of the first motor 25 and the resilient means 26. The second alignment member 23 is preferably slightly curved so that the lower edge is spaced far from the first alignment member 22 to thus provide a wide V opening for the bag edge 18. Also, the curvature means that as the bag edge approaches the closed V end, the top edge of the bag is pinched between the alignment members 22 and 23, and, hence, cannot fold over or buckle. This promotes precise locating of the top edge of the bag. When such top edge reaches the locator axis 19, the sensors 55 are activated. This sends a signal to the control circuit 58 so that it knows that a bag is properly located in the bag edge locator. If the sensors 55 are not activated, meaning an improperly aligned bag, the bag is rejected so that subsequent machinery will not attempt to fill an improperly aligned bag. This rejection in the preferred embodiment is by releasing the suction on the suction cups 49 on the bag holder 20.

In the preferred embodiment the control circuit controls the first motor 25 to move the bag holder 20 vertically. As it starts its movement, the control circuit 58 also controls the third motor 60 to begin its indexing movement. Thus the bag 16 is moving vertically as it rotates 180° with the rotatable frame 32. As soon as the bag 16 has moved laterally away from in front of the suction cups 34–37, which may be about a 45° rotation, then the control circuit 58 controls the second motor 33 so that it advances toward the bag pickup station 17 to again pickup the next bag. This saves time in the sequential movement of the various parts of the bag aligner machine. The first motor 25 will have completed its movement and the bag edge 18 will be at the locator axis by the time the third motor 60 has indexed the frame 32 in its 180° indexing movement. The bag will then be in the phantom position 16A and may be taken away by a transfer arm 65 which moves the bag away in the direction of the arrow 66 and bends the top of the bag 63 in order to remove it from the bag edge locator 21, yet does not destroy the precisely located vertical position of the bag 16.

The edge 18 of the bag which is being located need not be an openable edge, for example, it might be a closed edge of the bag, especially on a valve-type of bag. Also, the movement of the bag 16 toward the locator axis 19 need not be vertical, the bag aligner machine might be tipped 90°, for example, so that the movement of the bag was generally horizontal. This might also make a more convenient orientation of the bag aligner for many types of bags such as valve bags. The second alignment member 23 is shorter than the first alignment member 22 in order that the top edge of the bag 18 may pass under this second alignment member 23 in its retractile movement from the magazine 12. The suction cups 49 hold the top portion 63 of the bag 16 so that the edge 18 is almost being pulled into the closed end of the V configuration of the alignment members 22 and 23, rather than being pushed into this confined area. This aids in preventing any buckling of the top portion 63 of the bag 16. The first alignment members 22 are spaced apart for this purpose in order to provide room for the suction cups 49 therebetween.

With this precise locating of the edge 18, then in subsequent filling of the bag, the openable top edge 18 of the bag may be folded over, and the adhesive on the bag inner face activated to seal the bag completely without any tiny apertures through which the contents of the bag might exit or through which vermin and the like might enter.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the circuit and the combination and arrangement of circuit elements may be resorted to without departing from the spirit and scope of the invention as hereinafter claimed.

What is claimed is:

1. A bag aligner machine for use with a bag pickup station comprising in combination, a base, an alignment station on said base and including a bag edge locator having a first and a second alignment member interconnected in generally a V configuration, a bag holder movable relative to said base toward and away from the open V end of said alignment members, means including resilient means and a first motor acting between said bag holder and said base to actuate said bag holder between a preliminary position and a bag edge locator position, and control means connected to control said motor and bag holder to actuate the bag holder for support of a bag thereby, to control said first motor to move said bag holder from said preliminary position to said bag edge locator position whereat an edge of the bag is moved into the open V end between the first and second alignment members to abut the closed V end under the urging of said resilient means.

2. A machine as set forth in claim 1, wherein said open end of said V configuration of alignment members is aimed downwardly, and said bag holder and first motor move a bag upwardly into the open end of said V configuration.

3. A machine as set forth in claim 1, wherein said open end of said V configuration is aimed downwardly, said first alignment member is disposed substantially vertically, and said second alignment member is shorter and disposed at an angle to the vertical.

4. A machine as set forth in claim 1, including a pair of first and second alignment members spaced apart with the closed ends of the V configurations thereof aligned along a locator axis, said first motor and bag holder moving an edge of a bag into the open V end to the locator axis.

5. A machine as set forth in claim 4, including said bag holder engaging a bag in the area between said first alignment members near that edge of the bag which is moved to said locator axis.

6. A machine as set forth in claim 4, including at least one suction cup in said bag holder engaging a face of a bag in the area near that edge of the bag which is moved to said locator axis.

7. A machine as set forth in claim 6, including two suction cups spaced apart a distance small enough to permit the suction cups to be positioned between said first alignment members.

8. A machine as set forth in claim 1, including a first slide carrying said bag holder, and means connecting said first motor to move said first slide.

9. A machine as set forth in claim 8, including a second slide, said connection means connecting said first motor to move said second slide, and said resilient means including urging means acting between said first and second slides.

10. A machine as set forth in claim 1, including a bag pickoff means for removing a bag from a bag supply and moving said bag to said preliminary position, said bag holder receiving the bag from said bag pickoff means at said preliminary position, said bag pickoff means including a pickoff arm mounted for movement relative to said base, a first and a second suction cup, means mounting said first suction cup fixed on said pickoff arm to engage a bag near an edge thereof in a bag pickup station and firmly pull the bag away from an adjacent bag as said pickoff arm retracts, and means resiliently mounting said second suction cup on said pickoff arm to engage any such bag in the bag pickup station and yieldingly pull such bag away from an adjacent bag as said pickoff arm retracts.

11. A machine as set forth in claim 10, including third and fourth suction cups mounted on said pickoff arm along a line common with said first and second suction cups to engage a bag in the bag pickup station and aid in partially creasing the bag to separate the bag from an adjacent bag as said pickoff arm retracts.

12. A machine as set forth in claim 11, including means fixedly mounting said third suction cup on said pickoff arm adjacent said first suction cup, and means resiliently mounting said fourth suction cup on said pickoff arm adjacent said third suction cup.

13. A machine as set forth in claim 10, including, a second motor connected to move said pickoff arm between a retracted preliminary position and an advanced position whereat said suction cups may engage a bag in a pickup station.

14. A machine as set forth in claim 13, including in said control means a means controlling said second motor to advance said pickoff arm to pickup a bag in the pickup station and retract to said preliminary position.

15. A machine as set forth in claim 14, including in said control means a means controlling the suction on said first and second suction cups to transfer a bag from said first and second suction cups to said bag holder with the bag at said preliminary position.

16. A machine as set forth in claim 1, including sensor means connected and positioned to sense the presence of a bag which is correctly aligned in said bag edge locator, and said control means being connected to said sensor means to control said bag holder to retain those bags properly aligned and to reject those bags improperly aligned.

17. A machine as set forth in claim 1, wherein said bag holder includes at least one suction cup with resiliency in a rotational direction between the lip of the cup and the mounting thereof, said resiliency permitting slight rotational movements of a bag in said bag holder to facilitate aligning said edge of a bag in said closed V end.

18. A machine as set forth in claim 17, wherein said bag holder includes a pair of resilient suction cups, and means mounting said pair of resilient suction cups closely together to permit slight rotational movement of a bag in said bag holder.

* * * * *